US006863380B2

(12) United States Patent
Kitazawa et al.

(10) Patent No.: US 6,863,380 B2
(45) Date of Patent: Mar. 8, 2005

(54) TONER USED IN IMAGE FORMING APPARATUS

(75) Inventors: Atsunori Kitazawa, Nagano-ken (JP); Kiyoteru Katsuki, Nagano-ken (JP); Nobuhiro Miyakawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/252,007

(22) Filed: Sep. 23, 2002

(65) Prior Publication Data

US 2003/0086714 A1 May 8, 2003

(30) Foreign Application Priority Data

Sep. 26, 2001 (JP) ..... 2001-294646
Sep. 26, 2001 (JP) ..... 2001-294647
Sep. 26, 2001 (JP) ..... 2001-294648

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 3,689,935 A 9/1972 Pressman et al.
5,036,341 A 7/1991 Larsson
5,963,495 A 10/1999 Kumar
5,984,456 A 11/1999 Bern
6,291,123 B1 9/2001 Ohno et al.
2001/0013883 A1 8/2001 Tanino et al.
2003/0001926 A1 * 1/2003 Itoh et al.

FOREIGN PATENT DOCUMENTS

| | | |
|---|---|---|
| EP | 1 093 033 A1 | 4/2001 |
| JP | 2000-21180 | 1/2000 |
| JP | 3045295 | 5/2000 |
| JP | 2000-246947 | 9/2000 |
| JP | 2000-310881 | 11/2000 |
| JP | 2000-355115 | 12/2000 |
| JP | 2001-505146 | 4/2001 |
| JP | 2001-171161 | 6/2001 |

* cited by examiner

*Primary Examiner*—Raquel Yvette Gordon
(74) *Attorney, Agent, or Firm*—Sughrue Mion, PLLC

(57) ABSTRACT

Toner is for use in an image forming apparatus of the TonerJet method, which satisfies any one of the following conditions: a) toner in which the content of reverse-polarity large-diameter toner is 10% by count or smaller; b) toner in which the content of reverse-polarity fine-powder toner is 2% by count or smaller; c) toner comprising a silica additive and a titanium oxide additive such that the content x of the titanium oxide additive is in the range of $0<x\leqq 1.5$ wt %. For instance, when an image is formed using toner satisfying the condition a) above, that is, toner in which the content of reverse-polarity large-diameter toner is 10% by count or smaller, filming does not occur and an image having an excellent quality is formed (denoted with "○"). On the other hand, when an image is formed using toner in which reverse-polarity large-diameter toner exceeds 10% by count, filming occurs and the quality of an image deteriorates (denoted with "X").

4 Claims, 15 Drawing Sheets

× FILMING OCCURRING AT DEVELOPMENT ROLLER/SPACER
○ FILMING NOT OCCURRING AT DEVELOPMENT ROLLER/SPACER

× IMAGE DEFECTS OCCURRING DUE TO CLOGGING
○ IMAGE DEFECTS NOT OCCURRING DUE TO CLOGGING

FIG. 16

| ADDED AMOUNT (wt%) | TRANSPORTED AMOUNT (mg/cm²) | ELECTRIFICATION AMOUNT (μC/g) | AMOUNT OF POSITIVELY ELECTRIFIED TONER (% BY COUNT) | CLOGGING |
|---|---|---|---|---|
| 0.0 | 0.55 | -10.1 | 19.0 | × |
| 0.2 | 0.46 | -10.1 | 8.6 | ○ |
| 0.5 | 0.48 | -9.5 | 8.8 | ○ |
| 1.0 | 0.45 | -7.1 | 9.5 | ○ |
| 1.5 | 0.47 | -4.0 | 17.6 | ○ |
| 2.0 | 0.49 | -2.1 | 25.8 | × |
| 3.0 | 0.47 | -0.8 | 37.6 | × |

CLOGGING ○ : NO WHITE STRIPE IN SOLID IMAGE
× : WHITE STRIPE EXISTING IN SOLID IMAGE

TONER USED IN IMAGE FORMING APPARATUS

BACKGROUND OF THE INVENTION

1. Field of the Invention

The present invention relates to toner used in an image forming apparatus, such as a copying machine, a facsimile machine and a printer, and particularly in an image forming apparatus in which transfer of toner from a toner carrier toward a back electrode is controlled so that the toner adheres to an image receiving member, such as a transfer paper, a copying paper, a recording paper and a transfer medium, and an image is accordingly formed.

2. Description of the Related Art

Over the recent years, an image forming apparatus of the TonerJet (Registered trademark) method has attracted an increasing attention as an image forming apparatus which can be structured smaller at a lower cost than an apparatus of the electrophotographic method.

In this type of image forming apparatus, transfer of toner from a toner carrier to an image receiving member is controlled, the toner is made selectively adhere to the image receiving member at various positions and an image is accordingly formed. In short, electrified toner is rubbed against on the surface of the toner carrier and a toner layer is formed on the surface of the toner carrier, a potential difference is applied between the toner carrier and a back electrode and an electrostatic field for transfer accordingly develops which makes the electrified toner transfer toward the back electrode from the toner carrier. Disposed between the toner carrier and the back electrode is toner transfer controlling means which comprises a plurality of toner passing apertures and control electrodes which surround the respective toner passing apertures. As a voltage applied upon each control electrode is controlled in accordance with an image signal, each toner passing aperture is electrostatically opened and closed, the electrified toner is made transfer from the toner carrier toward the back electrode through the toner passing apertures in accordance with the image signal mentioned above, and the toner adheres to the image receiving member which is positioned between the toner transfer controlling means and the back electrode. In this manner, a toner image corresponding to the image signal is formed on the image receiving member.

In this type of image forming apparatus, it is in theory possible to form an image using toner whose property is approximately similar to that of such toner which is used in a conventional image forming apparatus by electrophotography. However, since these different types of image forming apparatuses are different from each other in terms of structure and operation principle, there are slightly different quality requirements regarding toner to be used in these image forming apparatuses. Hence, when toner developed for a conventional image forming apparatus is used in an image forming apparatus of the TonerJet method, a satisfactory image quality may not be always obtained.

For instance, in an apparatus of the TonerJet method wherein a member such as a toner regulating blade is disposed in contact with a toner carrier for the purpose of electrifying the toner and restricting the thickness of toner layer, a filming phenomenon may occur that friction-induced heat development, pressing force and the like make toner particles fuse to the surface of the toner carrier. As filming occurs at the surface of the toner carrier, the toner can not stay uniformly on the toner carrier, and therefore, the density of an image becomes uneven, a toner image fails to be formed at a necessary position or other image defect is created.

In addition, as described later, in this type of image forming apparatus, a spacer is used widely to keep the gap constant between a toner carrier and toner transfer controlling means. In such an apparatus, filming may occur at the spacer as well as at the toner carrier. Since the spacer is disposed in contact with the toner layer, friction occurs between the spacer and the toner layer, which may make a portion of the toner forming the toner layer fuse to the surface of the spacer or may make the toner fusing to the toner carrier contact with the spacer and stick to the spacer due to filming. If such filming at the spacer occurs, the toner layer may get damaged or the gap may change, thereby deteriorating the quality of an image. Thus, it is necessary to consider filming not only at the toner carrier but filming at the spacer as well.

Further, for example, since toner transferring from the toner carrier always passes through the toner passing apertures, the transferring toner may partially adhere to the toner transfer controlling means and clog the toner passing apertures. In this case, the density of a toner image formed on the image receiving member degrades, printing becomes impossible or other image defects occur.

In order to form a toner image having an excellent image quality with an image forming apparatus to the TonerJet method, therefore, toner whose property is suitable to apparatuses of this method is desired.

SUMMARY OF THE INVENTION

A major object of the present invention is to provide toner which is suitable to an image forming apparatus in which transfer of toner from a toner carrier toward a back electrode is controlled, the toner adheres to an image receiving member such as a transfer paper, a copying paper, a recording paper and a transfer medium, and an image is accordingly formed.

According to the present invention, toner satisfies at least one of the following conditions: a) the content of toner having a second polarity, which is opposite to a first polarity for transfer properly from the toner carrier toward the back electrode, and a toner particle diameter of d or larger is 10% by count or smaller, where the symbol d is the number mean diameter of toner; b) the content of toner having the second polarity, and a toner particle diameter of (d/2) or smaller is 2% by count or smaller; and c) the toner comprises mother particles, a silica additive and a titanium oxide additive in such a manner that the content x of said titanium oxide additive satisfies the following relationship: $0<x\leqq 1.5$ wt %.

The toner according to the present invention may be toner which is manufactured by any method such as a pulverization and a polymerization method as long as the toner satisfies any one of the conditions above.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 16 is a chart which shows a result of experiment of image defects attributed to clogging of toner passing apertures, which was obtained using toner which were different in terms of added amount of titanium oxide.

DETAILED DESCRIPTION OF THE PREFERRED EMBODIMENTS

Figure 1:
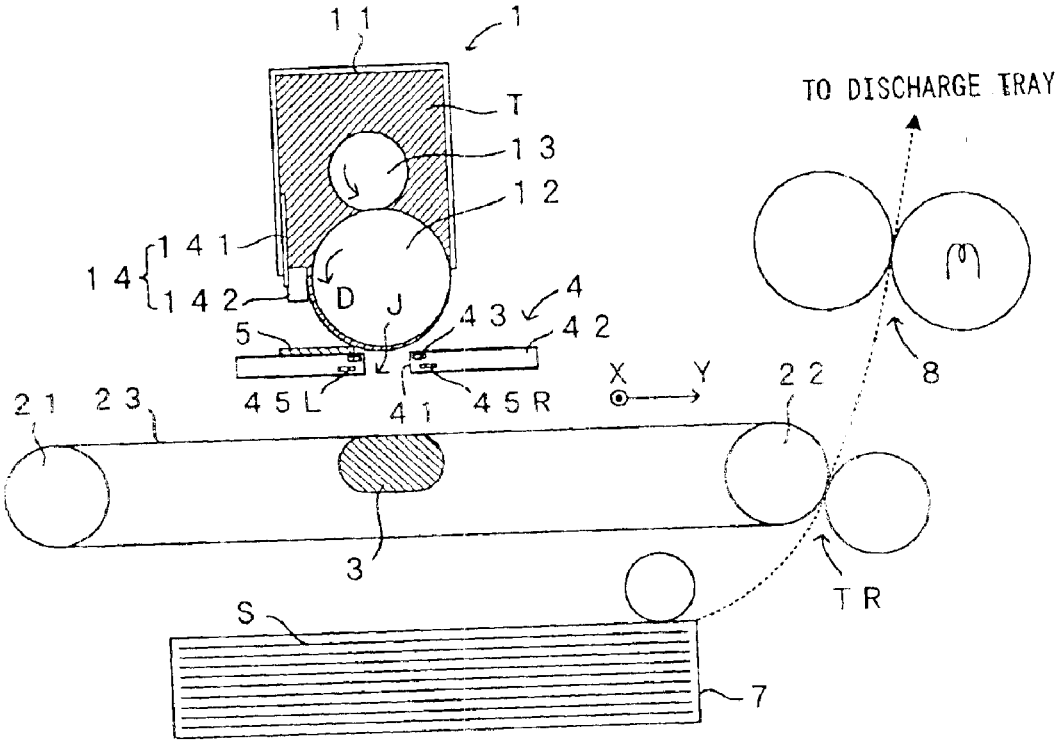
FIG. 1 is a drawing which shows one example of an image forming apparatus in which toner according to the present invention can be used.
Figure 2:
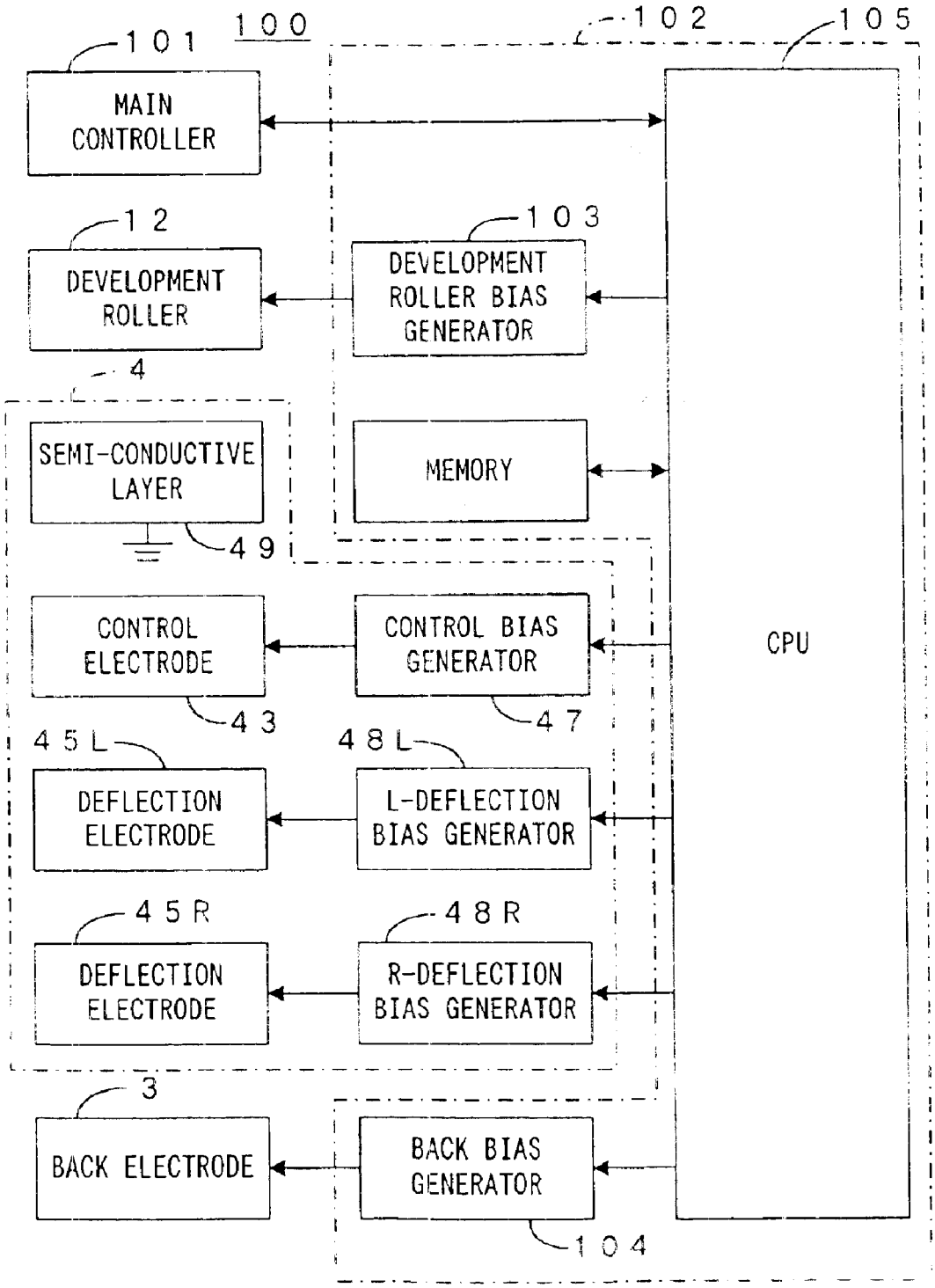
FIG. 2 is a block diagram showing an electric structure of the image forming apparatus shown in FIG. 1.

First, an image forming apparatus of the TonerJet method to which the toner according to the present invention is favorably applied will be described. FIG. 1 is a drawing which shows one example of an image forming apparatus in which toner according to the present invention can be used. FIG. 2 is a block diagram showing an electric structure of the image forming apparatus shown in FIG. 1. In this image forming apparatus, as an image signal is supplied from an external apparatus such as a host computer to a main controller 101 of a control unit 100, and an engine controller 102 controls respective portions of a developer 1 in accordance with a signal from the main controller 101. This makes toner transfer toward an intermediate transfer belt 23 which is stretched around two rollers 21 and 22, the toner adheres to the intermediate transfer belt 23, and a toner image corresponding to the image signal is formed.

In the developer 1, toner T serving as a developer agent is stored within a housing 11, and a development roller 12, a supply roller 13 and a regulating blade 14 are housed in the developer 1. The development roller 12 is a toner carrier which carries electrified toner (namely, electrified particles for creation of images) T, rotates at a predetermined peripheral velocity in an arrow direction D shown in FIG. 1 and accordingly transports the toner to a position (toner transfer starting position) J which is faced with a back electrode 3 which will be described later.

The development roller 12 is formed into a cylindrical shape and made of metal, such as aluminum and iron, or metal alloy. Further, a volt direct current is applied upon the development roller 12 from a development roller bias generator 103 which is disposed to the engine controller 102.

Brought into contact with an outer periphery of the development roller 12, the supply roller 13 rotates in an opposite direction to that of the development roller 12, thereby supplying the toner T to the development roller 12 and removing an excessive amount of the toner T from the development roller 12. The supply roller 13 is obtained by winding synthetic rubber such as urethane sponge around a metallic core for instance, and as the supply roller 13 comes into frictional contact with development roller 12, the supply roller 13 electrifies the toner T to a predetermined polarity. This apparatus will be continuously described below on the premise that the toner T is electrified to the negative polarity.

At a downstream position relative to the supply roller 13 in the direction D of rotation of the development roller 12, the regulating blade 14 is brought into contact with the outer periphery of the development roller 12 and accordingly electrifies the toner T to the negative polarity owing to friction with the development roller 12 while restricting the quantity of the toner T carried on the development roller 12. More specifically, the regulating blade 14 is formed by a plate-shaped metallic piece 141 which is fixed at its one end to the housing 11 and an elastic element 142 which is attached to the other end of the plate-shaped metallic piece 141. The elastic element 142 contacts the outer periphery of the development roller 12 and restricts the toner T. On the downstream side relative to the regulating blade 14 in the direction D of rotation of the development roller 12 (i.e., the feeding direction of the toner T) the regulating blade 14 restricts the thickness of a toner layer on the development roller 12 to the predetermined thickness.

The back electrode 3 is arranged to face with the development roller 12. More particularly, the back electrode 3, as shown in FIG. 1, is located on the opposite side of the intermediate transfer belt 23 to the development roller 12. A volt direct current which is higher than the voltage applied upon the development roller 12 is applied to the back electrode 3 from a back bias generator 104 which is disposed to the engine controller 102, whereby an electrostatic field for transfer which moves the toner T toward the back electrode 3 develops between the development roller 12 and the back electrode 3. Hence, because of the electrostatic field for transfer, the electrified toner T transfers toward the back electrode 3 from the development roller 12 at the toner transfer starting position J, and arrives at and adheres to the surface of the intermediate transfer belt 23 which serves as an image receiving member.

In addition, for the purpose of controlling transfer of the electrified toner T toward the intermediate transfer belt 23, a flexible printed circuit (hereinafter referred to as "FPC") 4 is disposed as a toner transfer controlling means between the development roller 12 and the back electrode 3. The structure and the function of the FPC 4 will now be described with reference to FIGS. 3 and 4.

Figure 3:
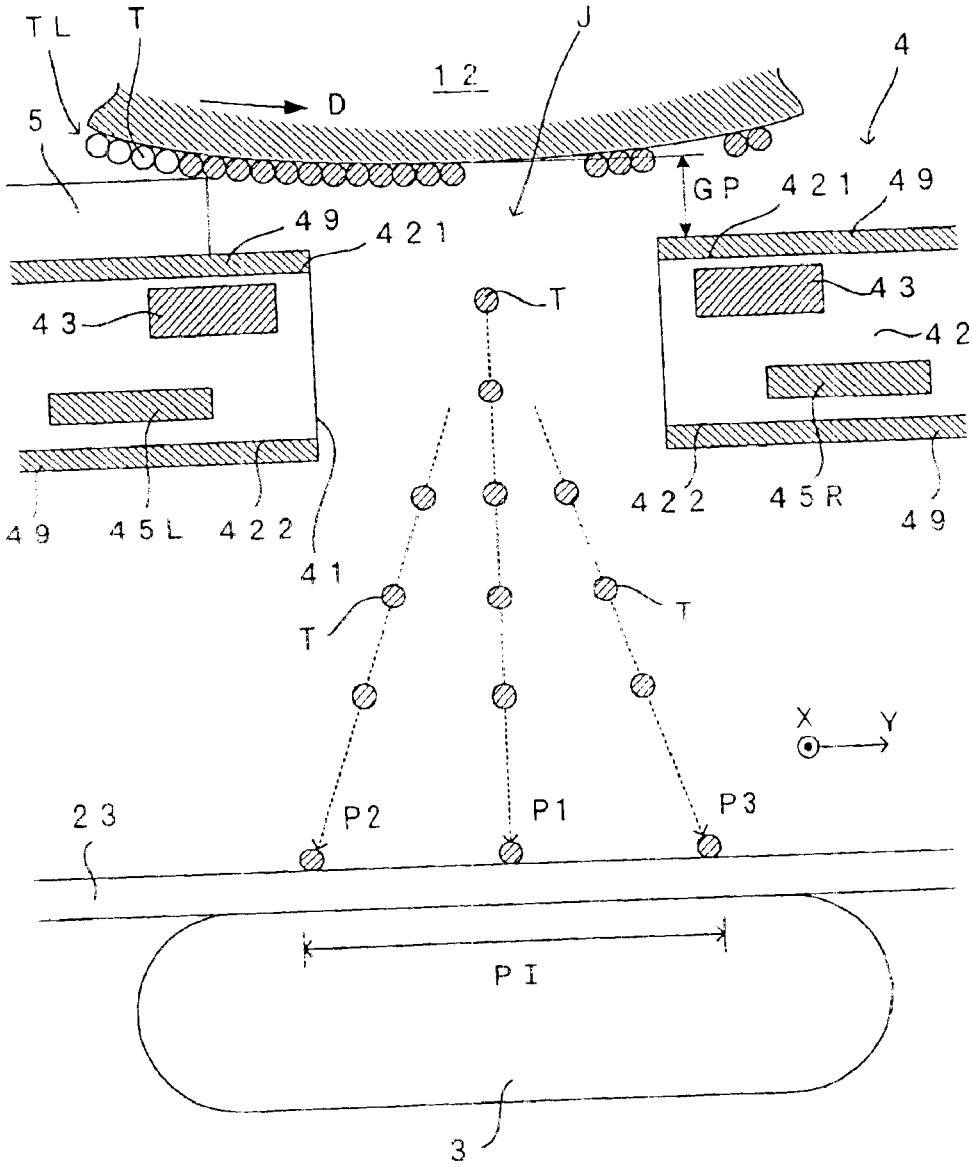
FIG. 3 is a partially expanded cross sectional view of a flexible printed circuit and a drawing of a toner transfer model.
Figure 4:
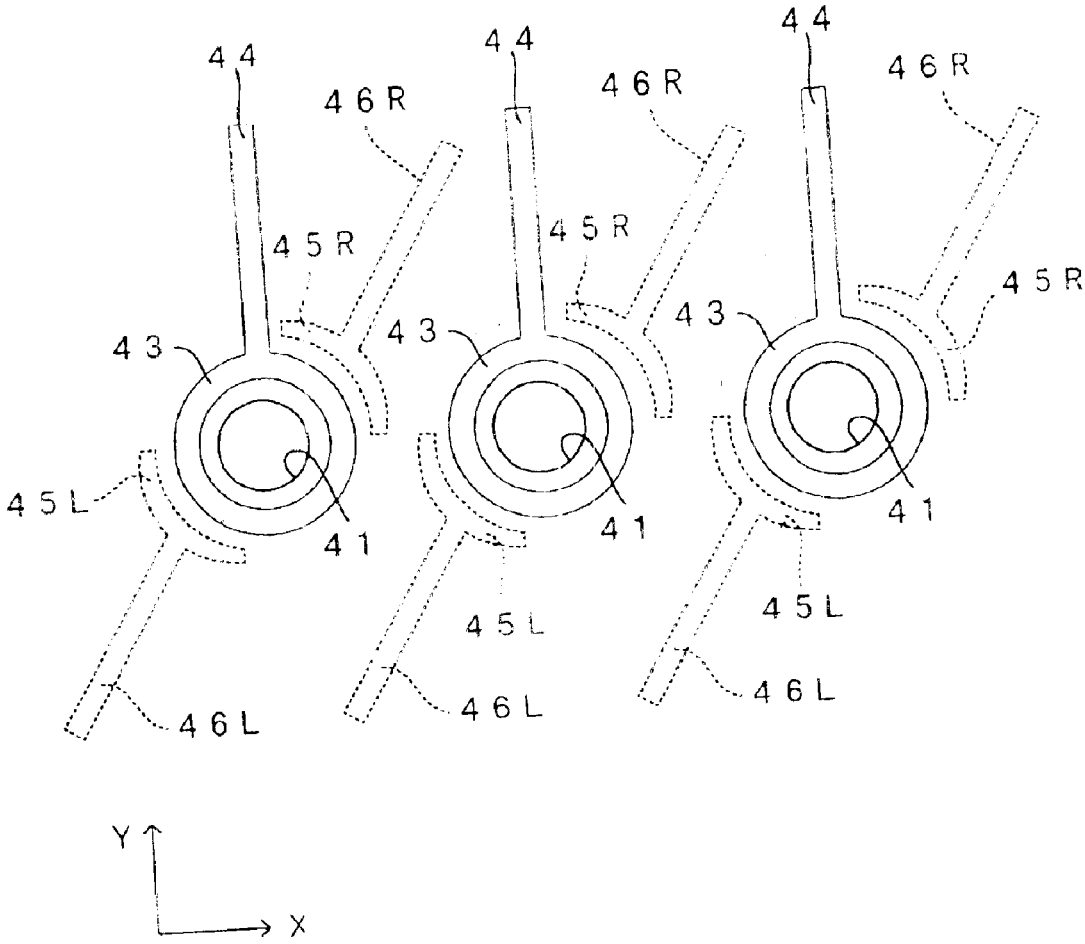
FIG. 4 is a drawing which shows a control electrode and a deflection electrode which are formed in a flexible printed circuit.

FIG. 3 is a partially expanded cross sectional view of the flexible printed circuit and a drawing which shows a transfer model of the electrified toner. FIG. 4 is a drawing which shows control electrodes and deflection electrodes which are formed in the flexible printed circuit. In this FPC 4, toner passing apertures 41 for guiding the electrified toner T to the back electrode 3 from the development roller 12 are formed in a base member 42 which is made of an electrical insulation material such as polyimide. Although only one toner passing aperture 41 is shown in FIG. 3, a plurality of toner passing apertures 41 are formed equidistantly in the form on one train in a direction perpendicular to the plane of FIG. 3 so that the electrified toner T can travel through the respective toner passing apertures 41 toward the back electrode 3. While this apparatus requires to arrange the toner passing apertures 41 in one train, the toner passing apertures 41 may be arranged in more one trains. In addition, with respect to the shape of the toner passing apertures 41, the toner passing apertures 41 may be round as in this apparatus, or alternatively, oval or polygonal.

Further, on the development roller 12 side of the base member 42, a control electrode 43 is formed in the shape of a ring to surround each toner passing aperture 41. From each control electrode 43, a lead line 44 runs in a direction perpendicular to the direction of the arrangement of the toner passing apertures 41. The shape of the control electrodes 43 is not limited to a circular shape, but may be any desired shape, such as an oval or polygonal shape for example, or further alternatively, a partially notched ring shape instead of a perfect ring shape.

Moreover, on the back electrode 3 side of the base member 42, for each toner passing aperture 41, paired deflection electrodes 45L and 45R are disposed so as to obliquely face with each other with respect to a feeding direction (i.e., a direction perpendicular to the train of the toner passing apertures) Y of the intermediate transfer belt 23 as shown in FIG. 4, and lead lines 46L and 46R extend respectively from the deflection electrodes 45L and 45R.

Although not shown in FIGS. 3 and 4, a control bias generator 47 (FIG. 2), an L-deflection bias generator 48L (FIG. 2) and a R-deflection bias generator 48R (FIG. 2) composed of high-voltage driver ICs are formed in the base member 42. Of these, the control bias generator 47 is electrically connected with each control electrode 43, and therefore, as an appropriate voltage is selectively applied in accordance with an open/close control signal from a CPU 105 of the engine controller 102, the toner passing apertures 41 described above electrostatically open and close. In other words, the electrostatic field for transfer is exposed between the development roller 12 and the back electrode 3 through the toner passing apertures 41 in such a manner that owing to the respective control electrodes 43, the electrified toner T jumps from the development roller 12, passes through the toner passing apertures 41 and transfers toward the back electrode 3. On the other hand, the exposure is limited, to thereby restrict transfer of the toner.

The L-deflection bias generator 48L is electrically connected with the deflection electrodes 45L, whereas the R-deflection bias generator 48R is electrically connected with the deflection electrodes 45R. As an appropriate voltage is selectively applied to each one of the deflection electrodes 45L and 45R in accordance with a deflection control signal supplied from the engine controller 102, the trajectory of the electrified toner T is switched among three directions described below.

(1) No Deflection: Arrow P1 in FIG. 3

When the same voltage is applied to both the deflection electrodes 45L and 45R, as denoted at the arrow P1 in FIG. 3, the electrified toner T passes straight through the toner passing aperture 41 and transfers onto a position corresponding to this toner passing aperture 41 on the intermediate transfer belt 23.

(2) Deflection to the Left: Arrow P2 in FIG. 3

When a higher voltage is applied to the deflection electrode 45L which is located on the left-hand side to the toner passing aperture 41 as compared to a voltage applied to the deflection electrode 45R which is located on the right-hand side to the toner passing aperture 41, the electrified toner T which is electrified to the negative polarity is deflected toward the left-hand side as denoted at the arrow P2 in FIG. 3 because of a deflecting electrostatic field which develops between the two deflection electrodes 45L and 45R.

(3) Deflection to the Right: Arrow P3 in FIG. 3

When a higher voltage is applied to the deflection electrode 45R which is located on the right-hand side to the toner passing aperture 41 as compared to a voltage applied to the deflection electrode 45L which is located on the left-hand side to the toner passing aperture 41, the electrified toner T which is electrified to the negative polarity is deflected toward the right-hand side as denoted at the arrow P3 in FIG. 3 because of a deflecting electrostatic field which develops between the two deflection electrodes 45L and 45R.

In this manner, according to this apparatus, while the trajectory of the electrified toner T is switched among the three directions, the electrified toner T transfers to a point of impact P1 on the intermediate transfer belt 23 including the range of deflection.

However, since the deflection electrodes 45L and 45R are located facing with each other in an oblique direction to the feeding direction Y of the intermediate transfer belt 23 as described above, in the three conditions above of (1) no deflection, (2) deflection to the left-hand side and (3) deflection to the right-hand side, when the intermediate transfer belt 23 is in a halt, three dots are formed on the intermediate transfer belt 23 which line up straight obliquely to the feeding direction Y of the intermediate transfer belt 23. In this case, if the feeding speed of the intermediate transfer belt 23 is set so as to advance the intermediate transfer belt 23 a quantity of deviation (distance) between adjacent dots in a dot printing cycle (period of time), the three dots will line up straight in a direction perpendicular to the feeding direction Y of the intermediate transfer belt 23. This allows to form three dots through one toner passing aperture 41, and hence, to increase the density of the dots.

Antistatic semi-conductive layers 49 are formed on a surface 421 on the development roller 12 side of the base member 42 and a surface 422 of the back electrode 3 side of the base member 42, and a ground potential is applied to the semi-conductive layers 49. These semi-conductive layers 49 have an optimal resistance value at a pre-set temperature (initial setup temperature), and release from the FPC 4 frictional charges which develop as the electrified toner T transferring as described above comes into contact with the FPC 4. This effectively prevents electrification of the FPC 4 and suppresses an influence over the electrostatic field for transfer and the deflecting electrostatic field. In short, it is possible to maintain an excellent printing quality while the temperatures of the semi-conductive layers 49 are kept at the initial setup temperature or within a tolerable temperature range.

On the upstream side to the toner transfer starting position J in the direction D of rotation of the development roller 12, between the FPC 4 having such a structure as described above and the development roller 12, a spacer 5 which expands in the longitudinal direction X of the development roller 12 (a direction perpendicular to the plane of FIG. 3) is inserted to the forward side to the toner passing apertures 41 of the FPC 4 as viewed from the rotation direction D. As the spacer 5 partially abuts on the toner layer TL which is carried on the development roller 12, a gap GP between the development roller 12 and the toner passing apertures 41 of the FPC 4 is defined so as to stay at a constant value.

In the image forming apparatus having such a structure as described above, as the image signal is supplied from an external apparatus to the main controller 101 of the control unit 100, the main controller 101 outputs a signal corresponding to the image signal to the engine controller 102. In the engine controller 102 receiving this signal, the CPU 105 supplies a control signal corresponding to this signal to the control bias generator 47, the L-deflection bias generator 48L and the R-deflection bias generator 48R, whereby the toner T transfers and adheres onto the intermediate transfer belt 23 and a toner image corresponding to the image signal is formed. In a predetermined transfer region TR, the toner image is transferred onto a sheet S, such as a transfer paper and a transparent sheet for an overhead projector, which is retrieved from a cassette 7. The sheet S now seating the image is then conveyed to a discharge tray not shown via a fixing unit 8.

An image forming apparatus in which toner according to the present invention can be used is not limited to the apparatus described above but may be an apparatus whose structure is as described below. More specifically, although the semi-conductive layers 49 are disposed for the purpose of preventing electrification of the FPC 4 in the apparatus above, the toner according to the present invention can be used in an image forming apparatus wherein semi-conductive layers for electrification prevention are not disposed.

Further, although the apparatus above is an image forming apparatus wherein the direction of transfer of electrified toner T is switched among three directions P1, P2 and P3 by means of deflection electrodes 45L and 45R, the toner according to the present invention is applicable to an image forming apparatus in which the direction of transfer of the electrified toner T is fixed.

Further, although a predetermined volt direct current is applied upon a development roller 12 from a development roller bias generator 103 in the apparatus above, the toner according to the present invention is applicable to an image forming apparatus in which the development roller 12 is grounded or a volt alternating current is applied upon the development roller 12.

Further, although the apparatus above is an image forming apparatus which forms an image with only one developer 1 to perform so-called monochrome printing, the toner according to the present invention is applicable to a color image forming apparatus of the so-called tandem method in which similar developers 1 for four types of toner of yellow, magenta, cyan and black are disposed in one train along a feeding direction Y of an intermediate transfer belt 23 or a sheet S for instance to thereby form a full-color image.

Next, toner which can be favorably used in an image forming apparatus having such a structure will be described as preferred embodiments of the present invention. However, the present invention is not restricted by those preferred embodiments, but of course may be exercised after modified appropriately to the extent matching the intention of the invention which will be described later, and such modifications are within the scope of the present invention. While a variety of properties of toner described in the following can be evaluated using equipment below for example, other equipment and method for evaluating similar properties may be used instead: E-Spart Analyzer (E-SPART2; HOSOKAWAMICRON CORPORATION) for evaluating particle diameters and electrification amounts of toner; an electrostatic voltmeter (MODEL344; TREK, INC.) for evaluating a surface potential of a toner layer.

As a result of various experiments and observation, the inventors of the present invention found that an existence of toner electrified to a second polarity, particularly toner whose particle diameters is large responsible for filming at a toner carrier. The second polarity is opposite to a first polarity for transfer toward a back electrode from the toner carrier. The toner having the second polarity remains on the toner carrier without transferring at a toner transfer starting position. Friction is arisen between the remained toner and a toner regulating blade or the like to thereby fuse together the toner into a toner film. The inventors of the present invention also found that filming can be prevented if the content of toner electrified to the second polarity and whose particle diameters are d or larger (hereinafter referred to as "reverse-polarity large-diameter toner") is set to 10% by count or smaller where the number mean diameter of the toner is d.

Figure 5:
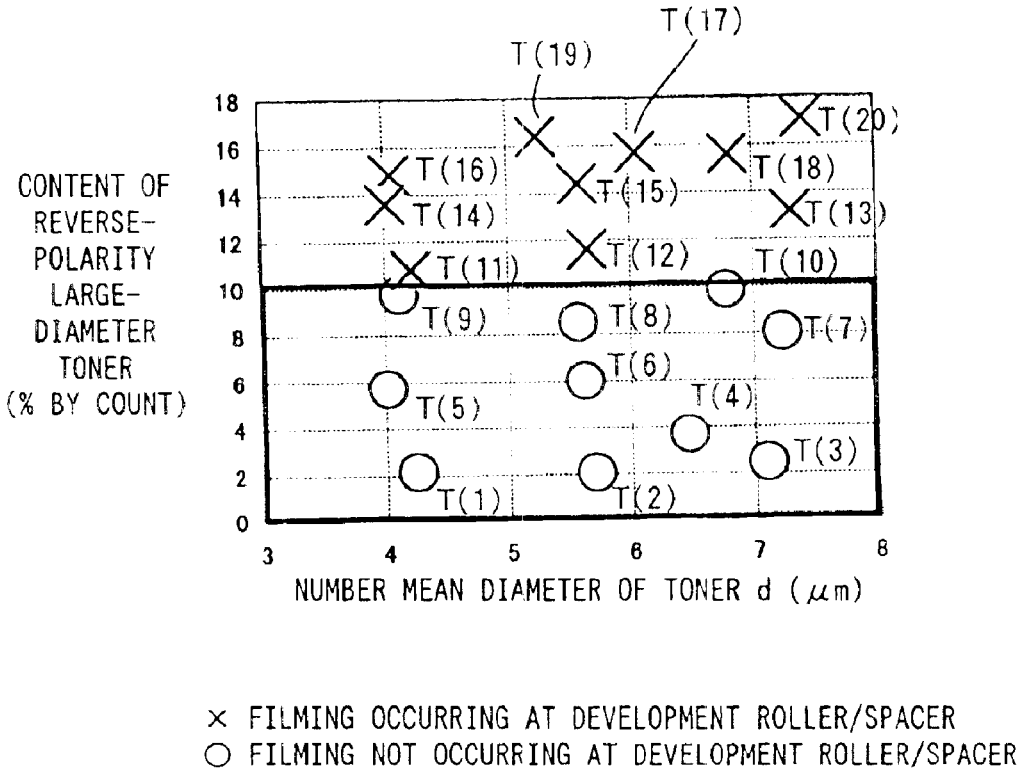
FIG. 5 is a graph which shows a result of experiment of filming to a development roller or a spacer, which was obtained using toner which were different in number mean diameter and/or content of reverse-polarity large-diameter toner.

Twenty types of toner T(1) through T(20) mutually different in terms of combination of number mean diameter d of toner and content (% by count) of reverse-polarity large-diameter toner were prepared. Images were formed with the image forming apparatus shown in FIG. 1 using such toner, and whether filming occurred on the surface of the development roller 12 or a spacer 5 was verified. FIG. 5 is a graph summarizing the results.

Figure 6A:
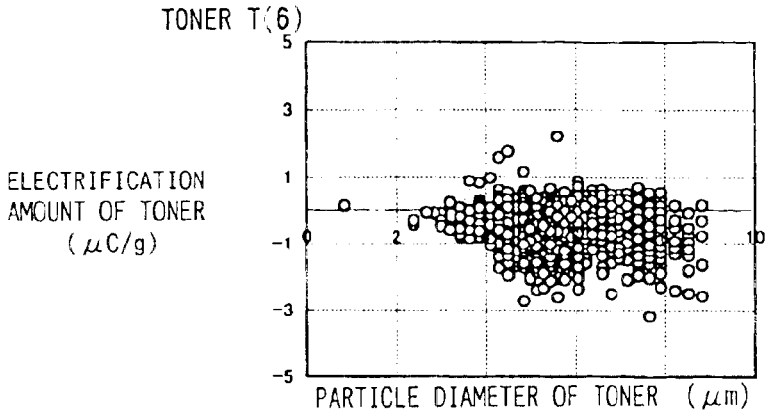
FIGS. 6A through 6C are graphs each of which shows one example of a distribution of electrification amounts of the toner used in the experiment shown in FIG. 5.
Figure 6B:
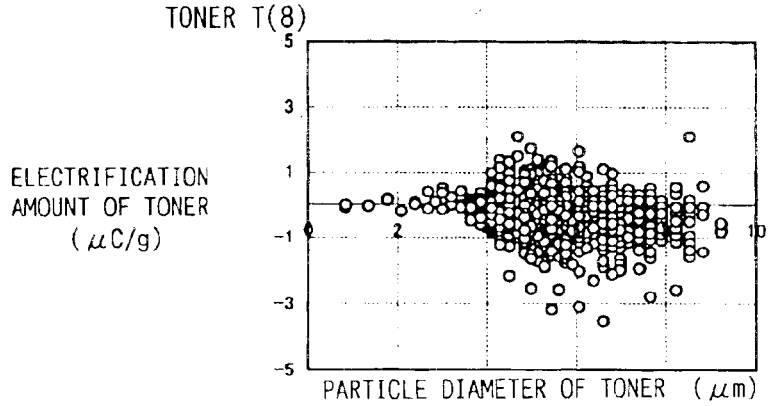
Figure 6C:
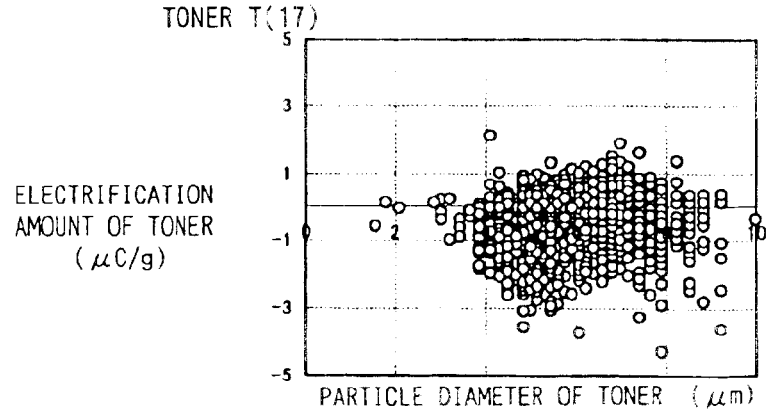

The number mean diameter d ($\mu$m) and the content (% by count) of the reverse-polarity large-diameter toner regarding each one of the toner T(1) through T(20) were calculated based on the measurement results with E-Spart Analyzer mentioned above. For instance, with respect to the toner T(6), T(8) and T(17), distributions of electrification amounts at 3000 counts identified with E-Spart Analyzer are as shown in FIGS. 6A through 6C. Data (number mean diameter d, content) obtained from each piece of measurement data are as follows:

Toner T(6): (5.62 $\mu$m, 6.0% by count)

Toner T(8): (5.57 $\mu$m, 8.5% by count)

Toner T(17): (6.06 $\mu$m, 15.7% by count)

Data regarding the other toner were identified similarly.

As for toner causing filming at the development roller 12 or the spacer 5, corresponding coordinate positions (number mean diameter d, content) in FIG. 5 are denoted with the symbol "X." As for toner not causing filming, coordinate positions (number mean diameter d, content) in FIG. 5 are denoted with the symbol "○."

As shown in FIG. 5, when an image is formed using toner in which reverse-polarity large-diameter toner is contained in the amount of 10% by count or smaller, filming does not occur and an image having an excellent quality is formed. On the other hand, when an image is formed using toner in which reverse-polarity large-diameter toner is contained in the amount exceeding 10% by count, filming at the development roller 12 or the spacer 5 occurs.

Use of the toner according to the present invention in this image forming apparatus also realizes an effect of suppressing clogging of toner passing apertures 41. Once leaving toner, which is electrified to a first polarity which is the negative polarity for example, from the development roller 12, the toner would transfer toward the intermediate transfer belt 23. On the other hand, once leaving toner which is electrified to a second polarity (which is the positive polarity in this example), the toner transfers in a direction different from that of the toner having the first polarity to most often adhere to the FPC 4. Adhesion of such toner electrified to the second polarity is one of major causes of clogging of the toner passing apertures 41. In addition, the problem of clogging of the toner passing apertures 41 with the toner becomes more influential and serious as the toner particle diameters become larger. However, since the content of reverse-polarity large-diameter toner which is largely influential over clogging of the toner passing apertures 41 is suppressed to 10% by count or smaller in toner according to the present invention, clogging of the toner passing apertures 41 is effectively suppressed.

Further, the inventors of the present invention identified a phenomenon which serves as one of major causes of clogging of toner passing apertures in an image forming apparatus of the TonerJet method, as a result of various experiments and observation. That is, toner adheres and grows on toner transfer controlling means on the back electrode side of the toner transfer controlling means, and the adhering toner is toner whose particle diameters are (d/2) or smaller and having the second polarity (hereinafter referred to as "reverse-polarity fine-powder toner") which is opposite to the first polarity which is for transfer toward an image receiving member. The inventors of the present invention found that clogging of the toner passing apertures can be prevented if the content of the reverse-polarity fine-powder toner is suppressed to 2% by count or smaller. The symbol d is the number mean diameter of toner.

Figure 7A:
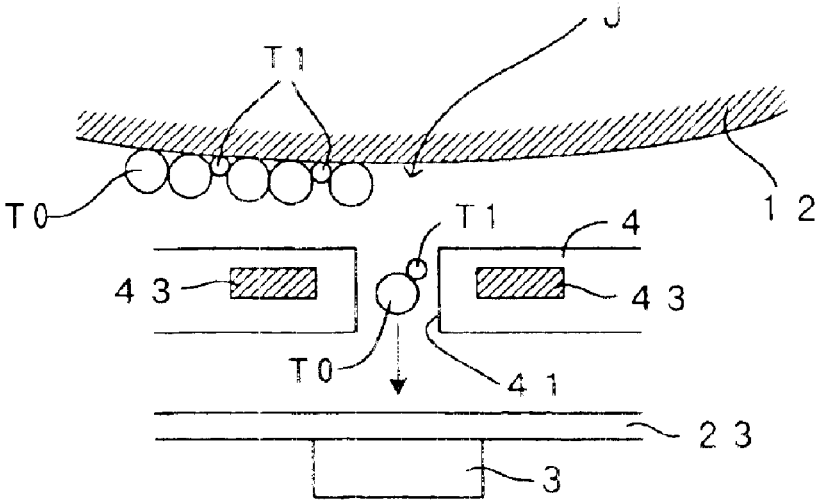
FIGS. 7A and 7B are schematic diagrams which show one example of a mechanism that toner passing apertures clog up.
Figure 7B:
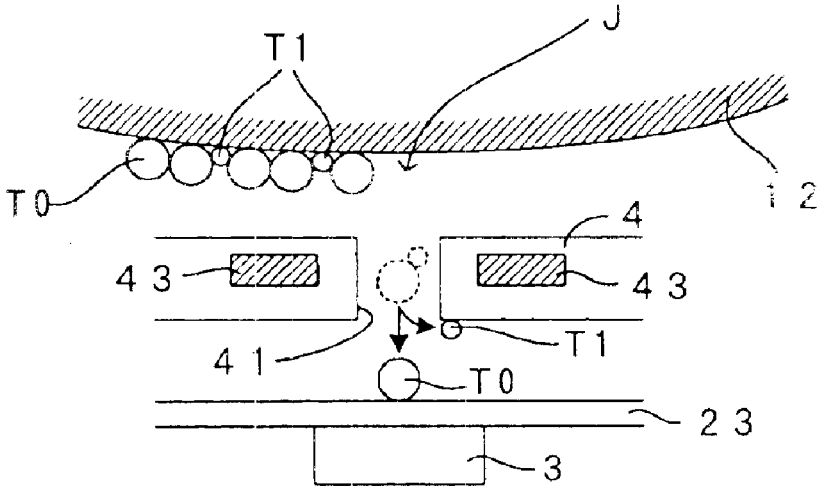

The inventors of the present invention believe that clogging of the toner passing apertures occurs in a mechanism as that shown in FIGS. 7A and 7B. With the development roller 12 which is a toner carrier carrying both toner T0 having an number mean diameter of d and electrified to the first polarity and reverse-polarity fine-powder toner T1 having particle diameters of (d/2) or smaller, the toner T0 and T1 get transported to a toner transfer starting position J. As control electrodes 43 cause the toner to transfer from the development roller 12 toward the back electrode 3, the toners T0 and T1 pass through the toner passing apertures 41 adhering together electrostatically (FIG. 7A). The negatively electrified toner T0 thus passing through the toner passing apertures 41 transfer as they are toward the back electrode 3 and arrive at the image receiving member 23, whereas the reverse-polarity fine-powder toner T1 is separated from the toner T0 by an electric field which develops between the control electrodes 43 (or the deflection electrodes 45L and 45R) and the back electrode 3 and adheres to the back electrode 3 side of a FPC 4 which serves as the toner transfer controlling means (FIG. 7B). Further, in a similar manner to the above, the reverse-polarity fine-powder toner transfers toward the back electrode 3 side of the FPC 4 one after another. As the reverse-polarity fine-powder toner flocculates and grows, the toner passing apertures 41 clog up. Conversely, if the content of toner (reverse-polarity fine-powder toner) having particle diameters of (d/2) or smaller and electrified to the second polarity is small, and to be more specific 2% by count or smaller, clogging of the toner passing apertures 41 is effectively prevented.

Figure 8:
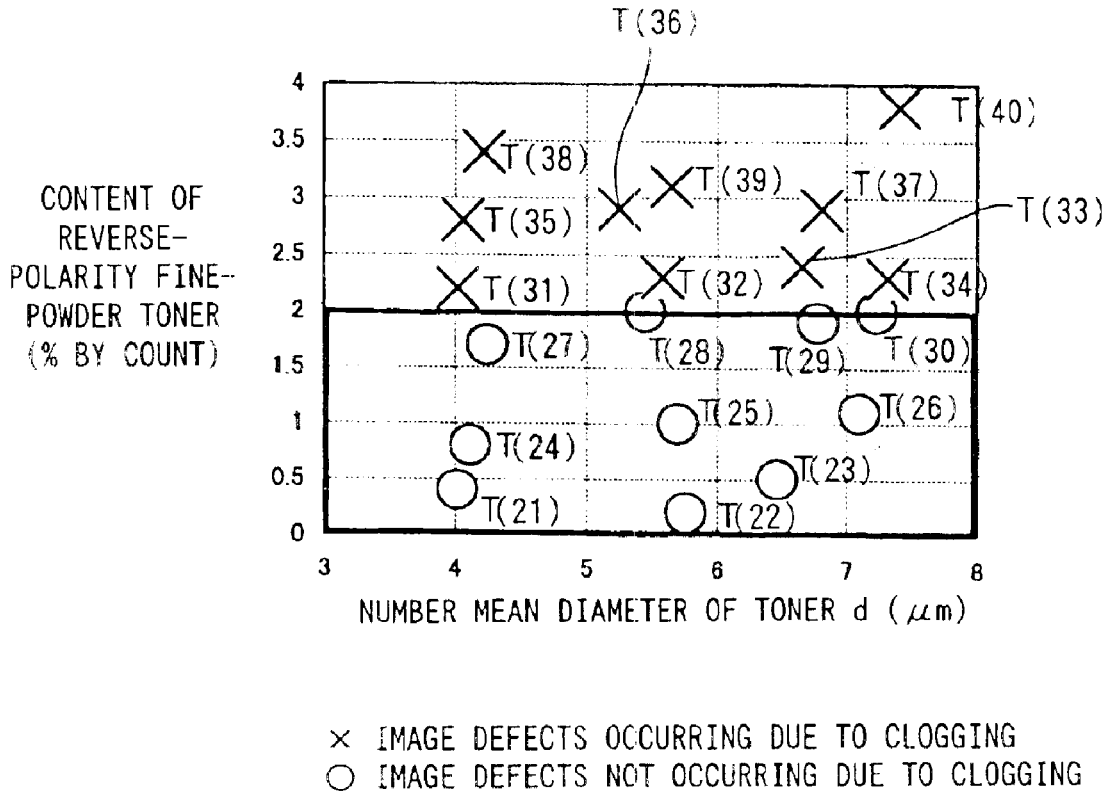
FIG. 8 is a graph which shows a result of experiment of image defects attributed to clogging of toner passing apertures, which was obtained using toner which were different in number mean diameter and/or content of reverse-polarity fine-powder toner.

Twenty types of toner T(21) through T(40) mutually different in terms of combination of number mean diameter d of toner and content (% by count) of reverse-polarity fine-powder toner were prepared. Images were formed with the image forming apparatus shown in FIG. 1 using such toner, and whether image defects attributed to clogging of the toner passing apertures 41 occurred was verified. FIG. 8 is a graph summarizing the results.

Figure 9A:
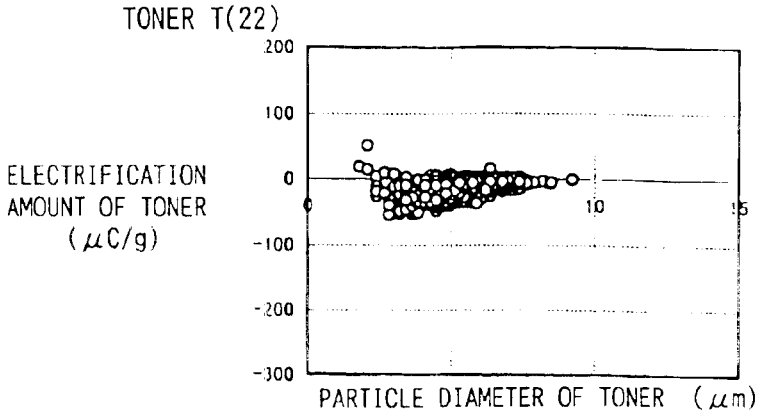
FIGS. 9A through 9C are graphs each of which shows one example of a distribution of electrification amounts of the toner used in the experiment shown in FIG. 8.
Figure 9B:
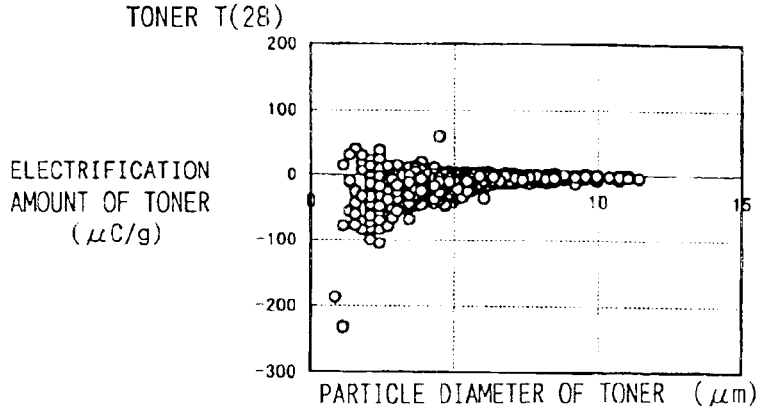
Figure 9C:
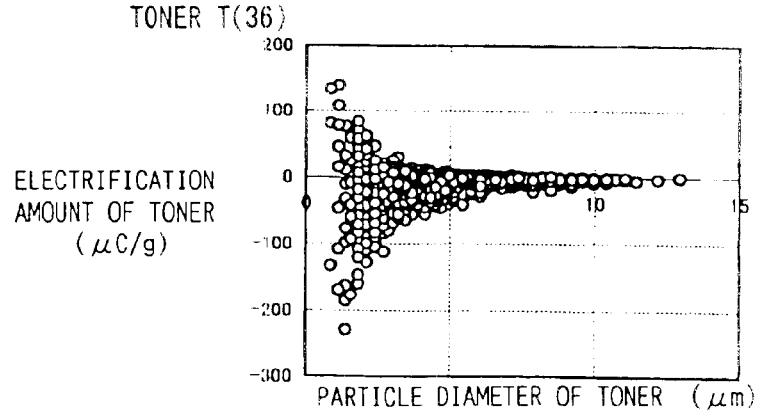
Figure 10:
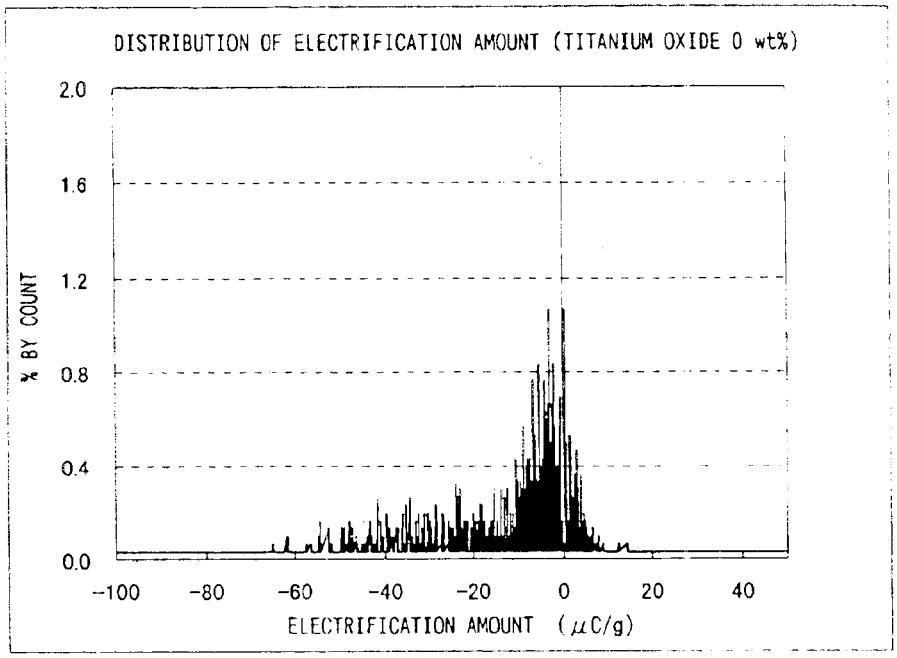
FIG. 10 is a graph which shows a distribution of electrification amounts of toner with no titanium oxide additive.
Figure 11:
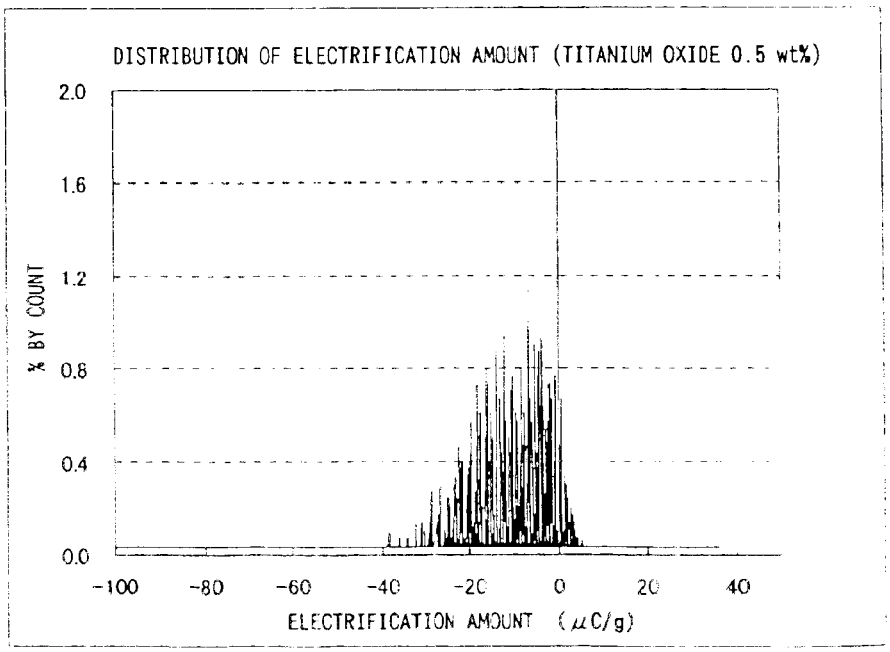
FIG. 11 is a graph which shows a distribution of electrification amounts of toner to which a titanium oxide additive is added in the amount of 0.5 wt %.
Figure 12:
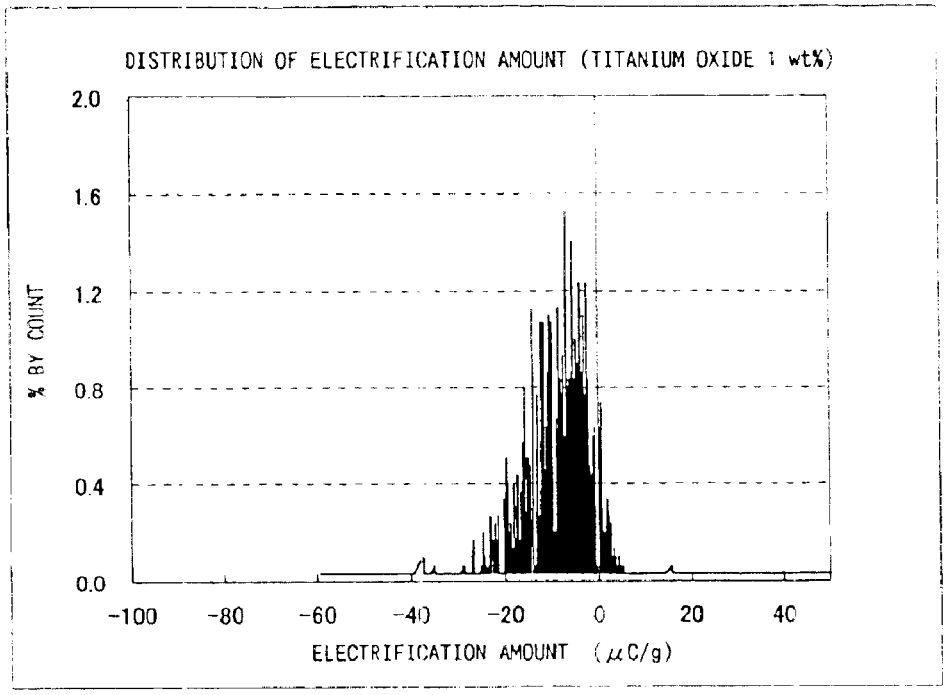
FIG. 12 is a graph which shows a distribution of electrification amounts of toner to which a titanium oxide additive is added in the amount of 1.0 wt %.
Figure 13:
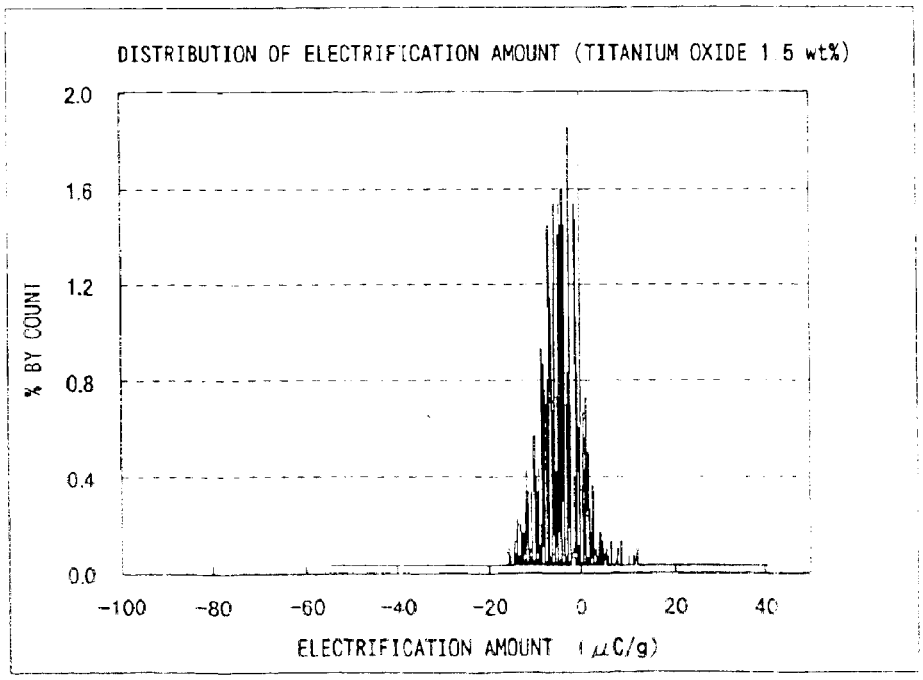
FIG. 13 is a graph which shows a distribution of electrification amounts of toner to which a titanium oxide additive is added in the amount of 1.5 wt %.

The number mean diameter d ($\mu$m) and the content (% by count) of the reverse-polarity fine-powder toner regarding each one of the toner T(21) through T(40) were calculated based on the measurement results with E-Spart Analyzer mentioned above. For instance, with respect to the toner T(22), T(28) and T(36), distributions of electrification amounts at 3000 counts identified with E-Spart Analyzer are as shown in FIGS. 9A through 9C. Data (number mean diameter d, content) obtained from each piece of measurement data are as follows:

Toner T(22): (5.76 $\mu$m, 0.2% by count)

Toner T(28): (5.45 $\mu$m, 2.0% by count)

Toner T(36): (5.25 $\mu$m, 2.9% by count)

Data regarding the other toner were identified similarly.

As for toner causing image defects attributed to clogging of the toner passing apertures 41, corresponding coordinate positions (number mean diameter d, content) in FIG. 8 are denoted with the symbol "X." As for toner not causing image defects owing to clogging of the toner passing apertures 41, coordinate positions (number mean diameter d, content) in FIG. 8 are denoted with the symbol "○."

As shown in FIG. 8, when an image is formed using toner in which reverse-polarity fine-powder toner is contained in the amount of 2% by count or smaller, an image having an excellent quality is formed without image defects attributed to clogging of the toner passing apertures 41. In contrast, when an image was formed using toner in which reverse-polarity fine-powder toner was contained in the amount exceeding 2% by count, image defects occurred because of clogging of the toner passing apertures 41 and an image having an excellent quality was not formed.

Furthermore, as a result of various experiments and observation, the inventors of the present invention identified other one of major causes of clogging of toner passing apertures in a conventional image forming apparatus. While a silica additive is customarily added to toner in many cases in an effort to improve the flowability and control electrification amounts, when such toner to which a silica additive is added is electrified to the negative polarity for instance, a distribution of electrification amounts of the toner is spread over a relatively wide range and there are toner excessively electrified to the negative polarity and positively electrified toner which is electrified to the opposite polarity. The toner over-electrified to the negative polarity, owing to image force acting upon the toner, firmly stay carried by the toner carrier, and therefore, the easiness of toner transfer, i.e., the transfer capability of the toner deteriorates, which in turn reduces the density of an image and degrades the quality of the image. Meanwhile, the positively electrified toner, affected by the force of an electric field developing between the toner transfer controlling means and the back electrode, adheres to edge portions of the toner passing apertures, portions around the toner passing apertures and the like, and accordingly clogs the toner passing apertures.

With a titanium oxide added to the toner as external additive, it is possible to prevent excessive electrification of the toner, suppress the image force which acts upon the toner, accordingly enhance the easiness of toner transfer and improve the density and the quality of an image. In addition, with the amount of toner having the reverse polarity decreased by adding the titanium oxide additive, it is possible to prevent clogging of the toner passing apertures. However, although if the added amount of the titanium oxide additive is relatively small, the amount of toner having the reverse polarity is less than where the titanium oxide additive is not added, the amount of toner having the reverse polarity contrarily becomes larger than where the titanium oxide additive is not added if the added amount of the titanium oxide additive exceeds 1.5 wt %. Noting this, it is desirable to set the content x of the titanium oxide additive to the range below:

$$0<x\leqq 1.5 \text{ wt } \%$$

Considering effective suppression of the amount of toner which is electrified to the reverse polarity in particular and effective prevention of clogging, it is more desirable to set the content x of the titanium oxide additive to the range below:

$$0.2 \text{ wt } \%\leqq x\leqq 1.0 \text{ wt } \%$$

Toner was prepared using 200V (diameter of primary particles is 12 nm) available from Nippon Aerosil Co., Ltd. and OX50 (diameter of primary particles is 40 nm) available from Nippon Aerosil Co., Ltd. as silica additives to be added to the toner and using titanium oxide marketed under the name of STT-30S by TITAN KOGYO KK as a titanium oxide additive to be added to the toner. The amount of added 200V and the amount of added OX50 were both fixed to 0.5 wt %, and the amount of added titanium oxide STT-30S was changed through eight levels of 0 wt %, 0.2 wt %, 0.5 wt %, 1.0 wt %, 1.5 wt %, 2.0 wt %, 2.5 wt % and 3.0 wt %, thereby preparing eight types of toner T(0), T(0.2), T(0.5), T(1.0), T(1.5), T(2.0), T(2.5) and T(3.0).

A housing 11 of the developer 1 was filled with each one of the toner T(0) through T(3.0), and using E-Spart Analyzer, the particle diameters and the electrification amounts of the toner taken from the toner carrier (which was the development roller 12 shown in FIG. 1) were measured. For instance, with respect to the toner T(0), T(0.5), T(1.0) and T(1.5), distributions of electrification amounts at 3000 counts identified with E-Spart Analyzer are as shown in FIGS. 10 through 13, respectively. Although measurement results (graphs of distributions of electrification amounts) are not shown in the drawings, using E-Spart Analyzer, the other toner T(2.0), T(2.5) and T(3.0) were measured similarly.

Figure 14:
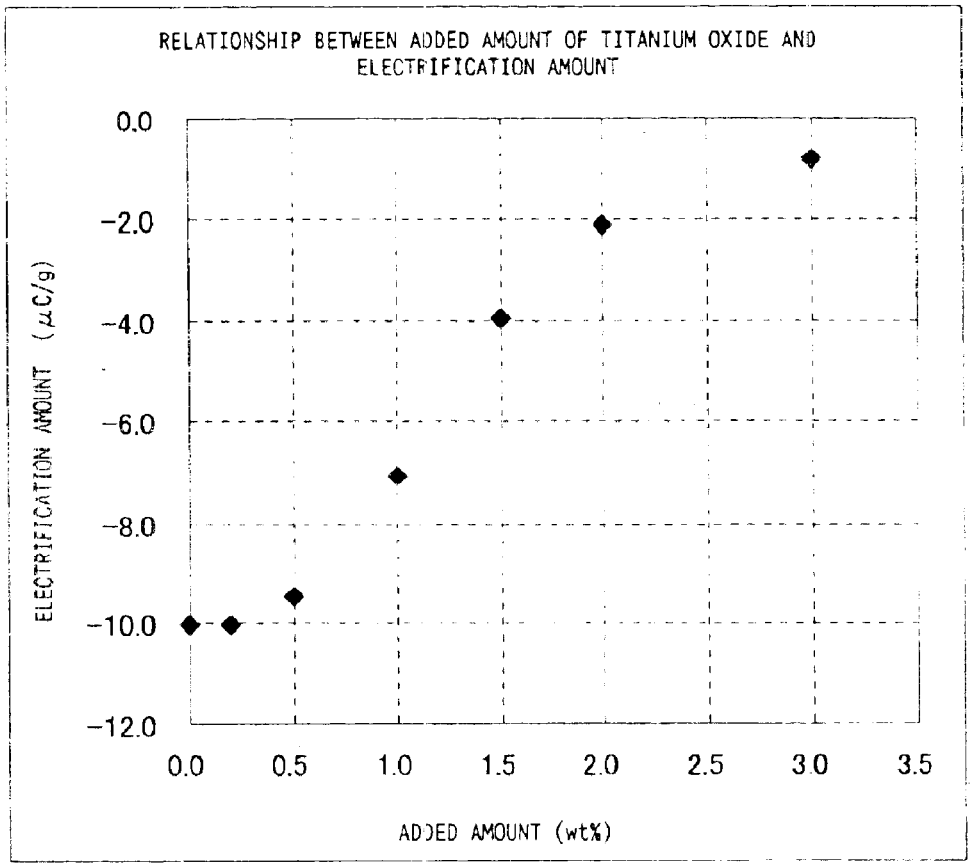
FIG. 14 is a graph which shows a relationship between the added amount of titanium oxide and an electrification amount.

The result in FIG. 14 was obtained, calculating an average electrification amount for each added amount based on these results.

Figure 15:
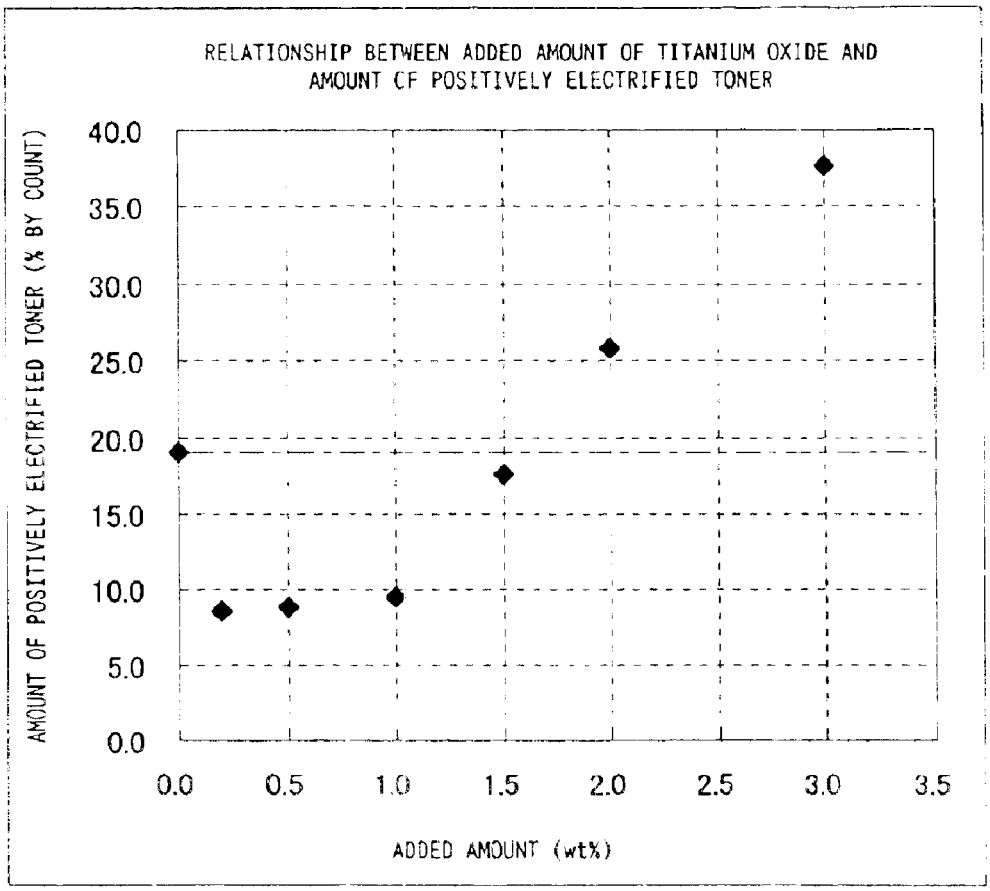
FIG. 15 is a graph which shows a relationship between the added amount of titanium oxide and the amount of positively electrified toner.

In addition, the amount of positively electrified toner (% by count) was calculated for each added amount based on the measurement results above, whereby the result in FIG. 15 was obtained. As FIG. 15 clearly shows, with titanium oxide added in the amount x so as to satisfy the following, the amount of positively electrified toner can be reduced to be less than the amount of positively electrified toner according to the conventional technique (the amount of positively electrified toner T(0): dashed line in FIG. 15):

$$0<x\leqq 1.5 \text{ wt } \%$$

Further, considering prevention of clogging of the toner passing apertures 41 by means of reduction in amount of positively electrified toner, it is more desirable to add the titanium oxide additive in the amount x so as to satisfy the following:

$$0.2 \text{ wt } \%\leqq x\leqq 1.0 \text{ wt } \%$$

Meanwhile, whether clogging occurred during formation of an image with the toner T(0) through T(3.0) was evaluated in accordance with whether an image defect showing characteristic white stripe appeared on a "solid" image on a white sheet S using the image forming apparatus shown in FIG. 1. FIG. 16 shows the result. As shown in FIG. 16, when an image was formed using toner in which the titanium oxide additive was contained in the range from 0.2 wt % to 1.5 wt %, a white stripe did not appear on the sheet S and clogging of the toner passing apertures 41 was not found. In contrast, when toner in which no titanium oxide additive was used or the titanium oxide additive was contained in the amount of 0.2 wt % or more was used, white stripes were confirmed which represented clogging of the toner passing apertures 41.

Further, in an image forming apparatus having a structure as that shown in FIG. 1, the toner layer restricted by a regulating blade 14 always comes into contact with the spacer 5 before transported to the toner transfer starting position J, and the contacting increases the electrification amount of the toner and gives rise to excessive electrification, which may serve as one of major causes of a deteriorated image quality.

Figure 17:
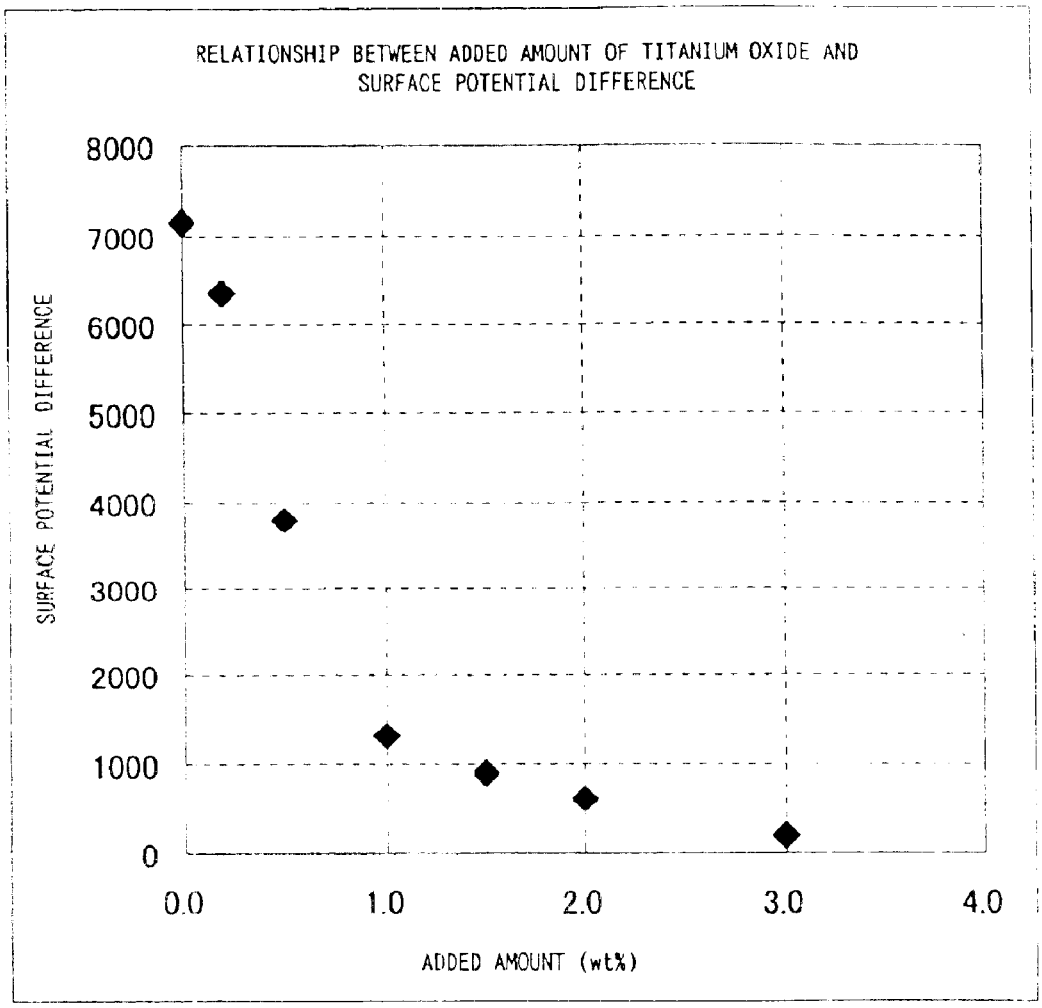
FIG. 17 is a graph which shows a relationship between the added amount of titanium oxide and a surface potential difference.

To verify this phenomenon, with the housing 11 of the developer 1 was filled with each of the eight types of toner T(0) through T(3.0), surface potentials of a toner layer TL before and after the contact with the spacer 5 were measured in various areas along an axial direction (X-direction) of the development roller 12, and differences between the pre-contact potentials and the post-contact potentials were calculated. Thus calculated differences were integrated along the axial direction (X-direction) of the development roller 12, and "surface potential differences" associated with the respective added amounts (0 wt %, 0.2 wt %, 0.5 wt %, 1.0 wt %, 1.5 wt %, 2.0 wt %, 2.5 wt % and 3.0 wt %) were calculated. FIG. 17 is a graph summarizing this.

As shown in FIG. 17, the surface potential differences dramatically decreased as the titanium oxide additive was added to the toner, and a change in electrification amount became smaller between before and after the contact with the spacer 5. Hence, with the titanium oxide additive added to the toner, it is effectively possible to prevent excessive electrification of the toner from deteriorating the quality of an image.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. Toner for use in an image forming apparatus comprising:

a back electrode;

a toner carrier which carries toner; and a toner transfer controlling means which is disposed between said toner carrier and said back electrode, wherein a first content of said toner electrified to a predetermined polarity is transferred toward said back electrode from said toner carrier through toner passing apertures which are formed in said toner transfer controlling means, and arrive at an image receiving member which is transported between said toner transfer controlling means and said back electrode to thereby form a toner image, wherein, a percentage of a second content of said toner is 10% or smaller than a count of total toner particles contained in said toner, wherein said second content of said toner is electrified to a polarity opposite to said predetermined polarity and has a toner particle diameter of d or larger, where d is a number mean diameter of said toner.

2. Toner for use in an image forming apparatus comprising:

back electrode;

a toner carrier which carries toner; and a toner transfer controlling means which is disposed between said toner carrier and said back electrode, wherein said first content of said toner electrified to a predetermined polarity is transferred toward said back electrode form said toner carrier through toner passing apertures which are formed in said toner transfer controlling means, and arrive at an image receiving member which is transported between said toner transfer controlling means and said back electrode to thereby form a toner image, wherein, a percentage of a second content of said toner is 2% or smaller than a count of total toner particles contained in said toner, wherein said second content of said toner is electrified to a polarity opposite to said predetermined polarity, and has a toner particle diameter of (d/2) or smaller, where d is a number mean diameter of said toner.

3. Toner for use in an image forming apparatus comprising:

a back electrode;

a toner carrier which carries toner; and a toner transfer controlling means which is disposed between said toner carrier and said back electrode, wherein said toner is transferred toward said back electrode from said toner carrier through toner passing apertures which are formed in said toner transfer controlling means, and arrive at an image receiving member which is transported between said toner transfer controlling means and said back electrode to thereby form a toner image, said toner comprising mother particles, a silica additive and a titanium oxide additive, wherein a content x of said titanium oxide additive satisfies the following relationship:

$$0<x\leqq 1.5 \text{ wt } \%.$$

4. The toner for use in an image forming apparatus of claim 3, wherein said content x of said titanium oxide additive satisfies the following relationship:

$$0.2 \text{ wt } \%<x\leqq 1.0 \text{ wt } \%.$$

* * * * *